US005897141A

United States Patent [19]

Dugmore et al.

[11] Patent Number: 5,897,141

[45] **Date of Patent: *Apr. 27, 1999**

[54] FILE STIFFENER

[75] Inventors: Peter Balfour Dugmore; Gwendy Helen Hayward, both of Rondebosch; Paul Bunn, Western Cape, all of South Africa

[73] Assignee: Designodev Limited, St. Helier, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/798,905

[22] Filed: Feb. 11, 1997

Related U.S. Application Data

[63] Continuation of application No. PCT/GB94/01762, Aug. 11, 1994.

[51] Int. Cl.[6] ..... B42D 1/00

[52] U.S. Cl. ..... 281/20; 281/28

[58] Field of Search ..... 281/20, 29, 36, 281/45, 15.1, 21.1, 28, 51; 402/80 R, 73

[56] References Cited

U.S. PATENT DOCUMENTS

| | | | |
|---|---|---|---|
| 4,569,613 | 2/1986 | Thomas | 402/80 R |
| 4,997,207 | 3/1991 | Feldman . | |
| 5,069,567 | 12/1991 | Fink et al. . | |
| 5,590,909 | 1/1997 | Urban et al. | 402/80 R |
| 5,634,666 | 6/1997 | Lee | 402/80 R |

FOREIGN PATENT DOCUMENTS

| | | | |
|---|---|---|---|
| 0206911 | 12/1986 | European Pat. Off. | 402/80 R |
| 166811 | 4/1934 | Germany | 281/36 |
| 1121029 | 1/1962 | Germany | 402/80 R |
| 2505654 | 8/1976 | Germany . | |
| 2249755 | 5/1992 | United Kingdom | 402/80 R |

OTHER PUBLICATIONS

Jacobs Gardner Office Supply Catalog, p. 873, item "B", Dec. 1990.

*Primary Examiner*—Willmon Fridie, Jr.
*Attorney, Agent, or Firm*—Fulbright & Jaworski, LLP.

[57] ABSTRACT

The invention relates to a file stiffener for stiffening a file of the type having a pair of opposed covers hinged to and spaced apart from one another by a spine, in particular for ring binder and lever arch-type files. The file stiffener comprises at least one rigidifying spacer element, and mounting means for mounting the spacer element between the opposed covers, the spacer element being dimensioned to hold the covers apart in a rigid parallel configuration.

15 Claims, 6 Drawing Sheets

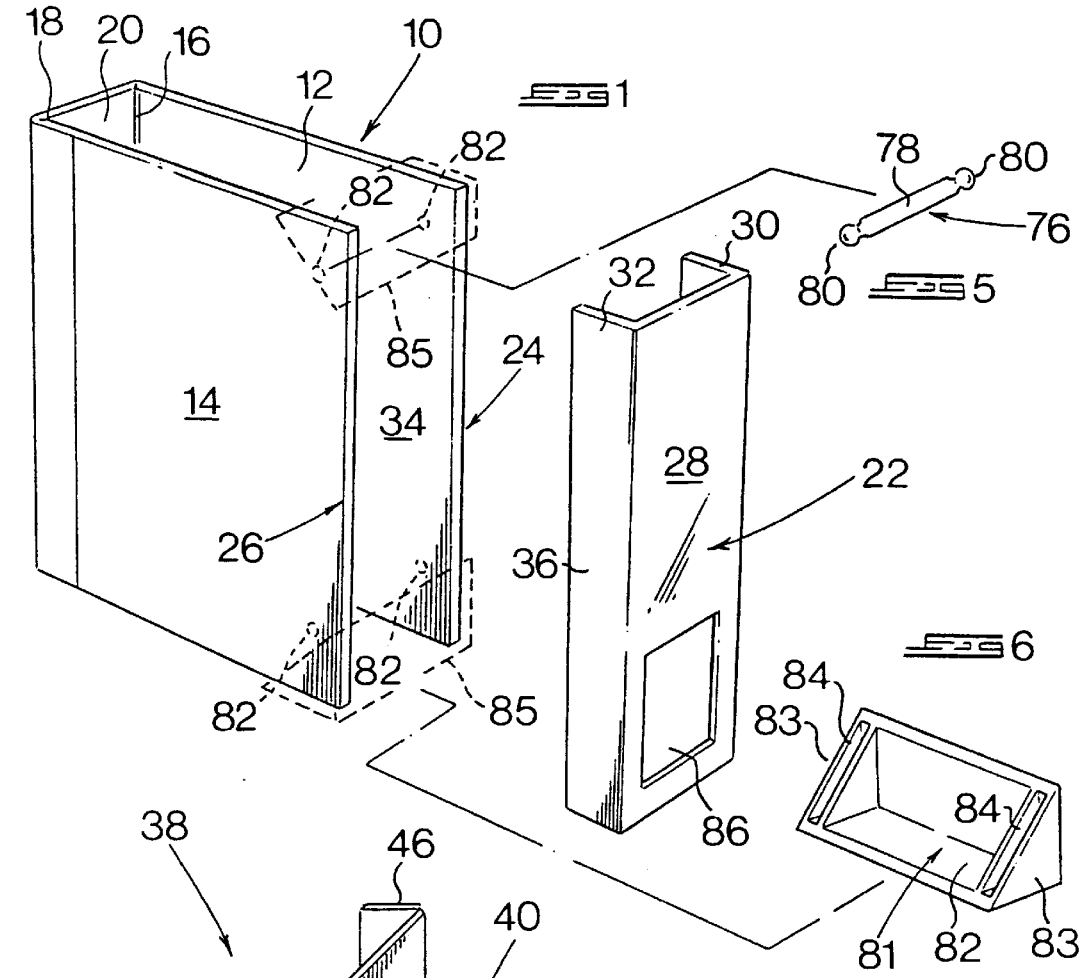
Fig 1
Fig 5
Fig 6
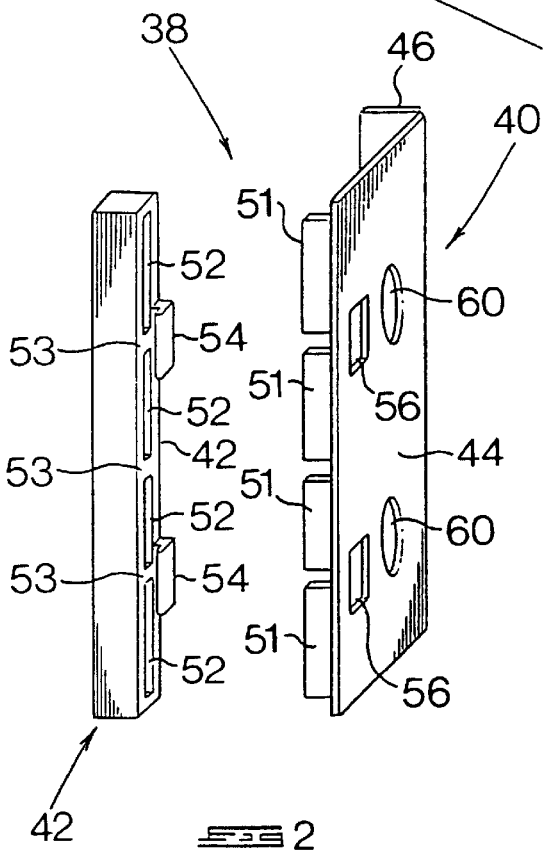
Fig 2
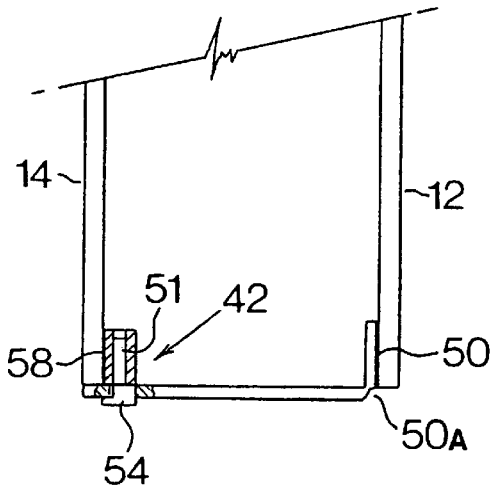
Fig 2A

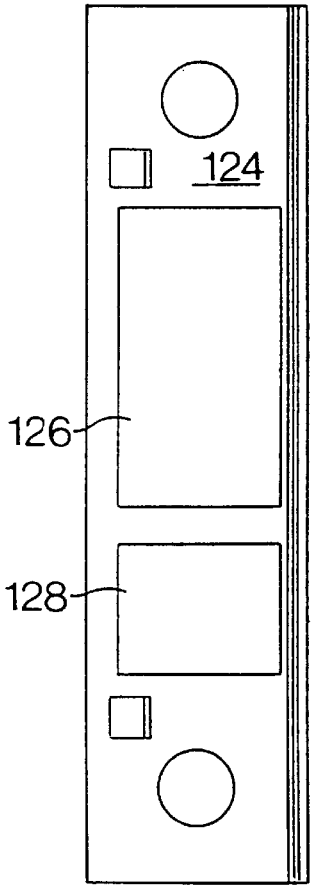
9
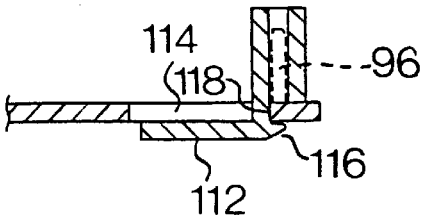
9
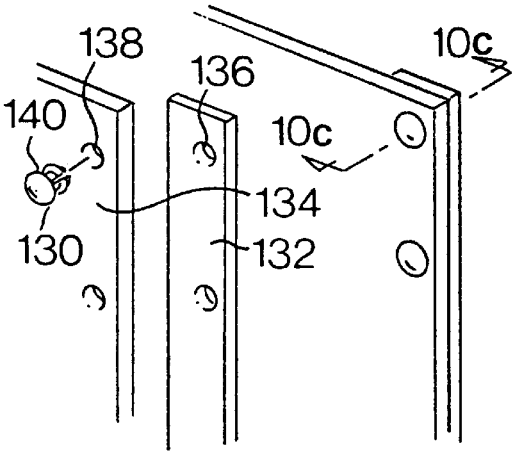
10A 10B
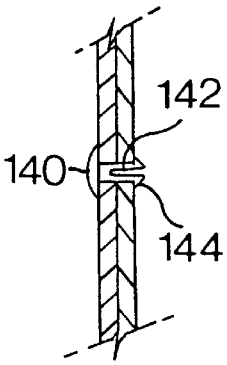
10c
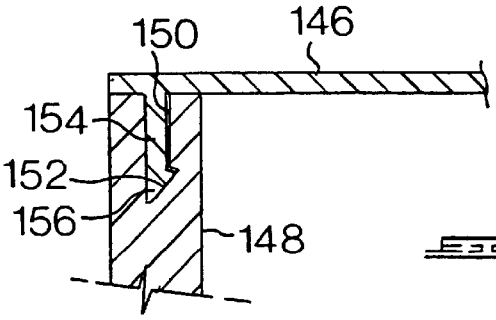
11

FILE STIFFENER

RELATED APPLICATIONS

This application is a continuation of international application serial no. PCT/GB94/01762 filed Aug. 11, 1994.

BACKGROUND TO THE INVENTION

THIS invention relates to a file stiffener, and in particular to a stiffener for ring binder and lever arch-type files.

Unless ring binder and lever arch-type files are filled to their capacity, the opposed file covers are inclined towards one another, with the result that, when viewed from above, the file has a triangular or trapezoidal profile. Partly filled files cannot be newly or efficiently stacked together when the spine width is greater than the gap between the free ends of the file cover. Additionally, because file covers are typically open and unsupported on three sides, asymmetrical acute and obtuse angles are defined between the file covers and the spine, so that the covers are not held uniformly at right angles to the spine. This in turn leads to a tendency for the files to tilt sideways and ultimately to deform. Yet another notable disadvantage of conventional lever arch files, is that their design is such that all the weight of the filed contents is supported by only one of the opposing file covers. As the contents get heavier, the vertical shear moment on the opposing file covers become progressively imbalanced, further contributing to instability and distortion of the file.

The rigid parallelepipedal structure of box files avoids the stacking and stability problem which arises with lever arch files. Box files are generally more expensive as well as being more cumbersome and bulky than lever arch files which are capable of accommodating a similar volume of documentation, and they are less convergent to use.

SUMMARY OF THE INVENTION

According to the invention there is provided a file stiffener for stiffening a file of the type having a pair of opposed covers hinged to and spaced apart from one another by a spine, the file stiffener comprising at least one rigidifying spacer element and mounting means for mounting the spacer element between the opposed covers, the spacer element being dimensioned to hold the covers apart in a rigid parallel configuration.

In a preferred form of the invention the rigidifying spacer element comprises a planar rigidifying flap arranged to be mounted between the free edges of the covers remote from and parallel to the spine, so as to define a rigid rectangular open-ended cylinder.

Preferably, mounting means are arranged to mount the rigidifying spacer element to the inner surfaces of the opposed covers, so that the file stiffener does not extend laterally beyond the outer surfaces of the file covers.

The planar rigidifying flap is typically hinged to a marginal flange which is arranged to be mounted by the mounting means to an inner surface of one of the file covers adjacent the free edge thereof, a flap engaging element is arranged to be mounted by the mounting means to an inner face of the other file cover, and fastening means are provided for fastening a free edge of the rigidifying flap detachably to the flap engaging element.

Advantageously, the fastening means comprise at least one tongue extending from the free edge of the rigidifying flap and at least one corresponding tongue-locating groove defined in the flap engaging element.

The fastening means may further include at least one clip formation extending from the flap-engaging element and a responding clip-receiving aperture defined in the rigidifying flap with which the clip formation is engageable in a snap fit.

Alternatively, the fastening means may include at least one clip formation extending from the rigidifying flap and a corresponding clip-receiving groove defined in the flap-engaging element with which the clip formation is engageable with in a snap fit.

Conveniently, the spacer element has substantially the same rectangular dimensions as the file spine, and includes an operatively outermost facade which has at least one zone for receiving indicia for identifying the file.

The mounting means may be chosen from a group including double-sided tape, adhesive, rivets, pop-fasteners, pop-rivets, hook-and-loop-adherent material, toothed metal clips and channel fasteners.

The rigidifying spacer element may optionally comprise a rectangular spine, and the mounting means may comprise channel formations extending along major side edges of the spine, the channel formations defining channels for accommodating in a friction fit the free edges of the file covers parallel to and remote from the file spine.

The rigidifying spacer element is conveniently adapted to become the exposed spine of the file, in that it has an operatively outermost surface defining a facade, and at least one recessed indicia-receiving zone for receiving labels or other indicia for identifying the file.

Ease of operation of the clip formation may be enhanced by the provision of thumb-and-finger purchase formations on the rigidifying flap, advantageously comprising apertures extending through the flap.

In one form of the invention, the rigidifying spacer element may comprise a plurality of rods having an effective length corresponding to the width of the file spine and terminating in mounting formations, and the file covers are provided, towards their free edges, with opposed complemental apertures for detachably mounting the rods in a snap or friction fit.

Alternatively, the rigidifying spacer element comprises a pair of elongate corner pieces, each corner piece having an effective length corresponding to the width of the file spine, and terminating in slotted mounting formations which are dimensioned to engage the free corners of the file covers in a friction fit.

The invention extends to a file comprising first and second planar covers hinged to and spaced apart from one another by a rigid spine, a rigidifying flap hinged to a free edge of the first cover remote from and parallel to the spine, a flap engagement formation located on an opposed free edge of the second cover flap fastening means located towards a free edge of the rigidifying flap, the fastening means being engageable with the flap engagement formation for fastening the flap detachably to the second cover, so as to form a rigid rectangular open-ended cylinder with the first and second covers being opposed and parallel to one another, and the spine and the flap being opposed and parallel to one another.

Conveniently, the flap has an operatively outermost file identification facade arranged to be visibly exposed when the file is in a stowed positions and including at least one zone for receiving indicia for identifying the file.

The fastening means may comprise at least one tongue extending from the flap, and at least one clip-receiving aperture defined in the flap, and the flap engagement formation comprises at least one corresponding tongue-locating groove and at least one resilient clip formation for engaging the clip-receiving aperture in a snap fit.

In a further embodiment, the fastening means comprises at least one lockable tongue and at least one corresponding groove formation within which the tongue is arranged to form a snap fit, the tongue projecting from the flap and the groove formation extending from the free end of the second cover.

Conveniently, the tongue projects in the plane of the flap and the groove formations extend perpendicularly from the second cover towards the tongue.

BRIEF DESCRIPTION OF THE DRAWINGS

FIG. 1 shows a perspective view of a lever arch file and a fist basic embodiment of a rigidifying element arranged to be fitted to the file;

FIG. 2 shows a perspective view of a second embodiment of a rigidifying element of the invention;

FIG. 2A shows a top cross-sectional view of the rigidifying element of FIG. 2 along the line 2A—2A when fitted to the free ends of the covers of a lever arch file;

FIGS. 5 and 6 show fifth and sixth embodiments of rigidifying elements of the invention.

FIG. 9 shows a front elevation of the rigidifying element of FIG. 7;

FIG. 9A shows a cross section on the line 9—9 of FIG. 8;

FIGS. 10A, 10B and 10C show respective exploded assembled and cross sectional views of a fastening arrangement for fastening the components of the rigidifying element to the file covers;

FIG. 11 shows a derail of an alternative fastening arrangement for detachably fastening the components of the rigidifying elements together;

DESCRIPTION OF EMBODIMENTS

Figure 3:
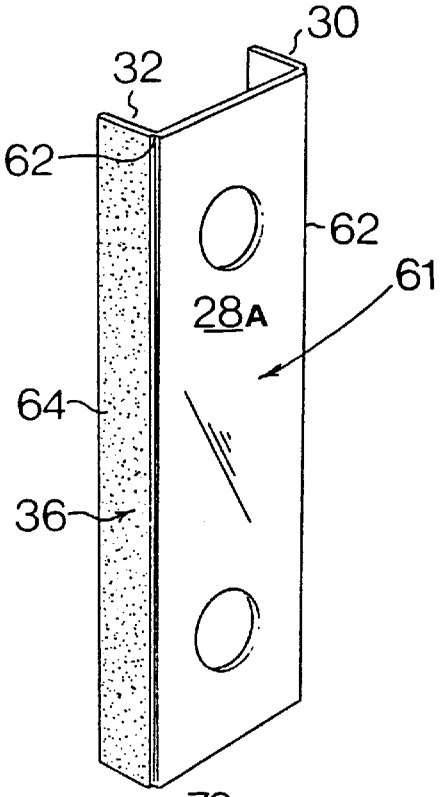
FIG. 3 shows a third embodiment of a rigidifying element of the invention.

Referring first to FIG. 1, a lever arch-type file 10 is shown comprising a pair of rigid covers 12 and 14 hinged at respective flexible hinge zones 16 and 18 to a rigid spine 20. The rigid spine 20 spaces the covers 12 and 14 apart at the hinged zones 16 and 18, and the capacity of the file is determined by the width of the spine 20. A file stiffener in the form of a rigidifying flap 22 is arranged to be mounted between the free ends 24 and 26 of the covers 12 and 14 so as to hold the covers 12 and 14 in a rigid spaced apart configuration in which they are parallel to one another. The rigidifying flap 22 comprises a central spacer 28 and a pair of flanges 30 and 32 extending at right angles from opposite sides of the spacer 28. The outer surface of the flange 30 is arranged to be fixed to an inner surface 34 of the flap 12 by means of glue, double-sided tape or the like, and the outer fastening surface 36 of the flange 32 is arranged to be fixed detachably to the inner surface of the cover 14 by means of a clip arrangement or the like.

Referring now to FIG. 2, a further embodiment of a file stiffener 38 comprises a rigidifying flap 40 and a flap engaging element 42, both of which are injection moulded from a plastics material. The rigidifying flap 40 has a rigid rectangular spacer 44 and a flange 46 hinged to one side of the spacer 44. As can clearly be seen in FIG. 2A, the outer surface of the flange 46 is affixed to the inner surface of the cover 12 by means of a length of double-sided tape 50, and the binge is defined by a flexible weakened zone 50A.

Four tongues 51 are arranged in a vertical column adjacent the opposite free edge of the spacer 44. Webs 53 divide the flap engaging element into four complemental grooves or channels 52 within which the tongues 51 are arranged to nest snugly in a friction fit. A pair of clips 54 extend from the engaging element adjacent the grooves 52, and are arranged to snap into a complemental pair of rectangular apertures 56 formed in the spacer 44 when the tongues are fully inserted into the channels, as is shown in FIG. 2A, which illustrates clearly how a length of double-sided tape 58 is used to mount the outer surface of the engaging element 42 to the inner surface of the file cover 14.

A pair of circular finger-engageable holes 60 are formed in the spacer 44 for facilitating thumb-operated disengagement of the clips 54 so as to permit separation of the flap engaging element 42 from the flap. The hinged flange 46 may be mounted to the inner surface of the file cover 12 either prior to documents being filed away, or with the documents already filed in situ between the file covers. The flap engaging element 42 is then mounted to the inner surface of the file cover 14 at the free end 26 thereof by means of the double sided tape 58, with the grooves 52 being positioned in alignment with the tongues 51.

Figure 3A:
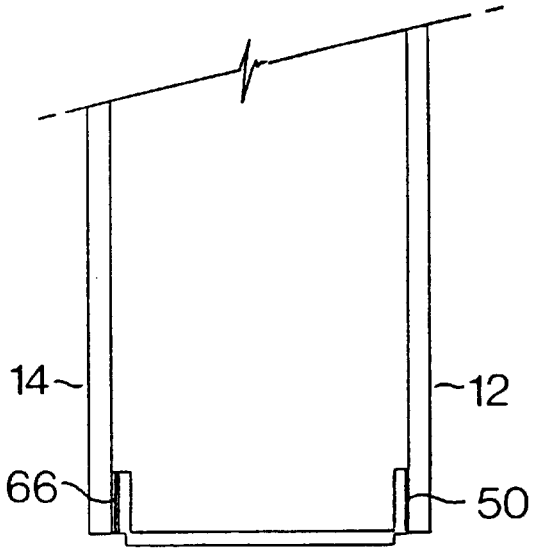
FIG. 3A shows a top plan view of the rigidifying element of FIG. 3 fitted to the free ends of the covers of a lever arch file.

Referring now to FIGS. 3 and 3A, a more simple embodiment of a rigidifying flap 61 is shown which is similar to the flap 22. The rigidifying flap 61 has a central spacer 28A flanked by a pair of flanges 30 and 32 which are hinged to the spacer 28A along weakened hinge zones 62. A strip of hook-adherent material 64 is glued onto the fastening surface 36, acting as a flap engaging element, and a corresponding strip of loop-adherent material 66 is glued onto an inner surface of the file cover 14. A strip of double sided tape 50 fixes the opposite flange to the inner surface of the file cover 12. The rigidifying flap 61 may be formed from rigid cardboard, plastic, fibre-filled or other resins, metal, wood, wood-composites or a rigid paper-based material.

Figure 4:
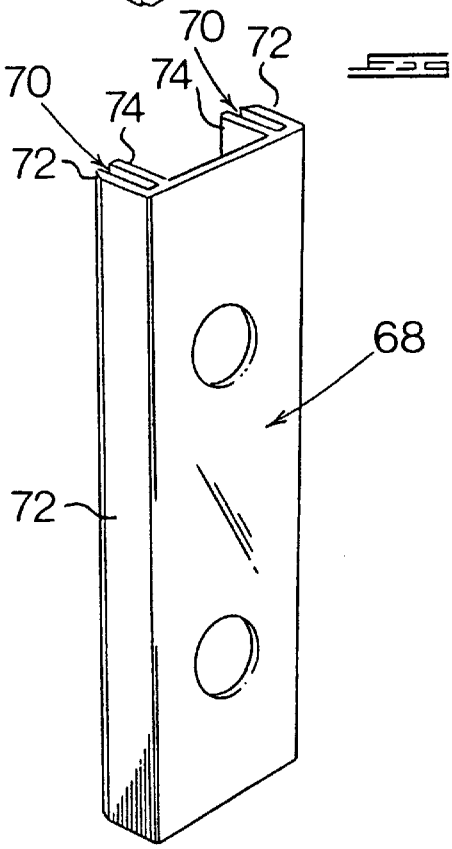
FIG. 4 shows a perspective view of a fourth embodiment of a rigidifying element of the invention.
Figure 4A:
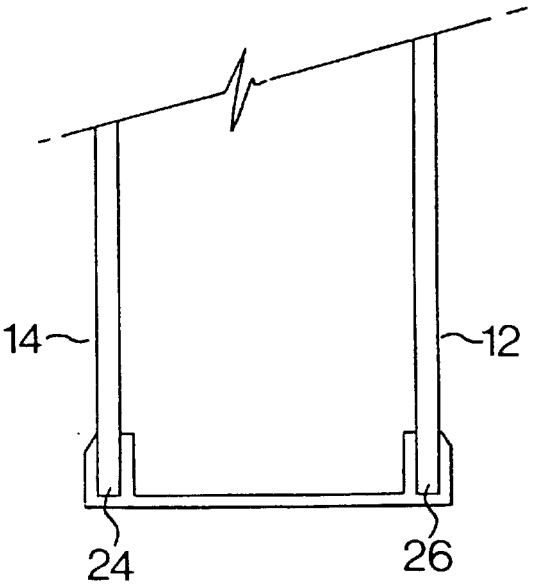
FIG. 4A shows a top plan view of the rigidifying element of FIG. 4 fitted to the free ends of the covers of a lever arch file.

Referring now to FIG. 4, a still further embodiment of a rigidifying element is shown in the form of moulded spine 68. The mounting means comprise of a pair of slots 70 which are defined between respective outer and inner pairs of flanges 72 and 74. The free ends 24 and 26 of the respective file covers 12 and 14 nest snugly in a friction fit within the complemental slots 70. The spine 68 is readily detachable, with the result that it ran easily be fitted to and removed from ring binder and lever arch-type file. Typically, the spine is formed from a plastics material fibre-filled or other resins, die-cast aluminium, or wood or paper composites.

In FIG. 5, a still further embodiment of a rigidifying element 76 is shown in the form of a rod 78 terminating in a pair of dumbbell-shaped formations 80. The covers 12 and 14 of the file may be provided with suitable engaging apertures 82 through which the formations 80 are arranged to pass in a snap fit.

Referring now to FIG. 6, a still further embodiment of a rigidifying element 81 is shown comprising a right-angled spacer 82 capped by a pair of diagonally slotted corner pieces 83. The slots 84 in the corner pieces 83 are arranged to nest snugly over the opposed corner ends of the file covers 12 and 14, as is shown in broken outline at 85 in FIG. 1.

Figures 7, 8:
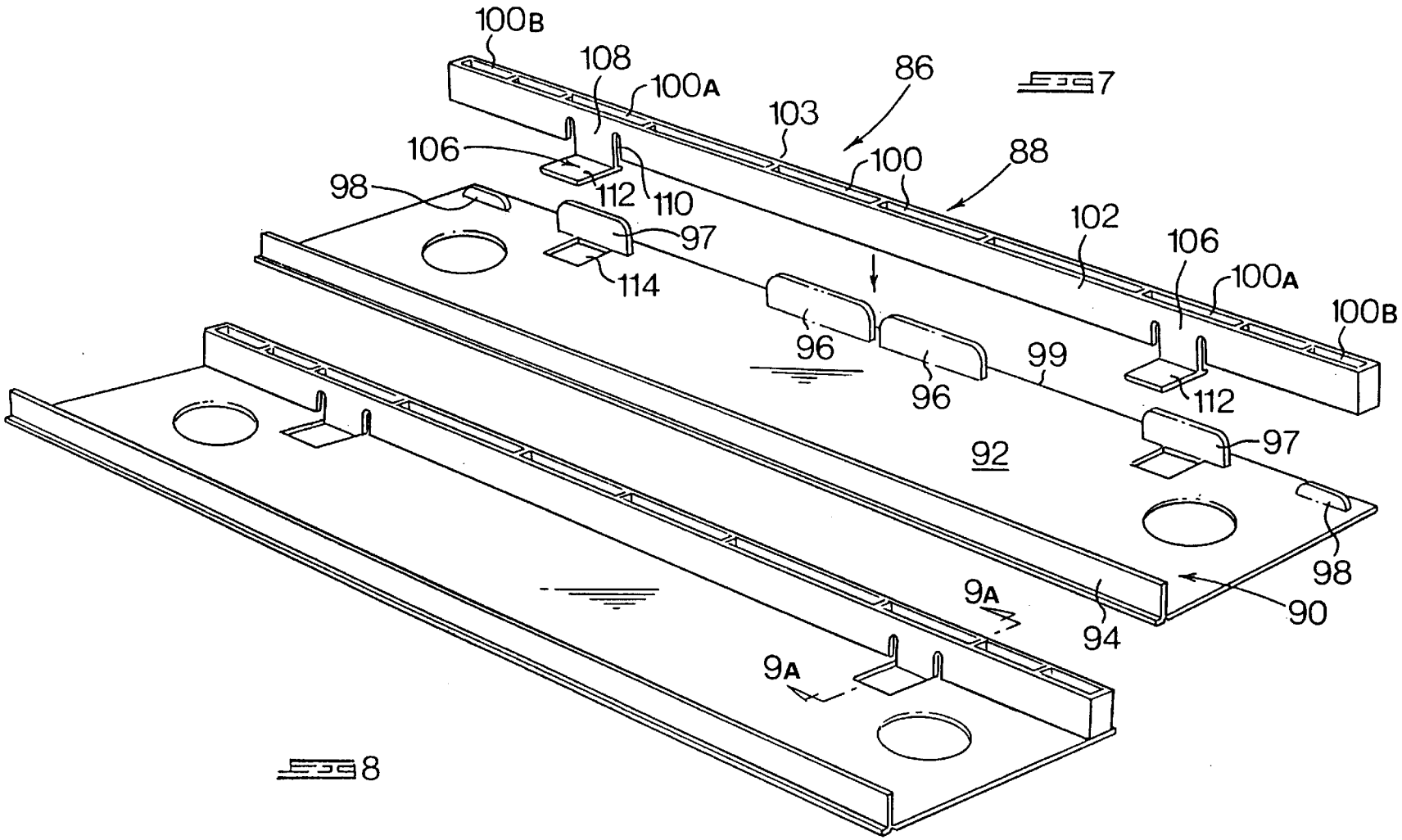
FIG. 7 shows an exploded perspective view of a seventh embodiment of a rigidifying element of the invention.
FIG. 8 shows an assembled perspective view of the rigidifying element of FIG. 7.

FIGS. 7 to 9 illustrate a preferred more refined embodiment of a file stiffener 86 of the invention. The file stiffener 86 comprises a flap engaging element 88 and a rigidifying element 90 having a spacer flap 92 hinged to a marginal flange 94 for anchoring the rigidifying element to an inner surface of the file cover. Pairs of matching tongues 96 97 and 98 are located adjacent a free edge 99 of the flap 92, and are sized to engage with respective complemental pairs of slotted apertures 100, 100A and 100B extending through the mounting element 88 in a snug complemental fit. In order to assist in locating the tongues 96, 97 and 99 within the apertures 100, 100A and 100B inner side wall 102 and the outer side wall 103 of the flapping-engaging element 88 are inwardly chamfered at the opening points of the apertures where the matching pairs of tongues first engage the apertures. Each of the tongues 96 and 97 have opposed minor ends 101 which are arranged to abut against corresponding stop formations 101A provided by webs 101B which in turn define the slotted apertures 100, 100A and 100B.

A pair of locking tabs 106 extend from the inner side wall 102. The locking tabs 106 have a resilient bridging portion 108 defined by grooves 110 formed in the inner side wall, and terminate in a foot 112 extending at right angles from the bridging portion 108. Each foot 112 is arranged to locate in complemental apertures 114 formed in the spacer flap 92. As is clear from FIG. 9A, the feet 112 are provided with heel portions 116 which form a snap fit behind an outermost edge 118 of the aperture 114. In order to assist in aligning the mounting and rigidifying elements 88 and 92, the pairs of tongues 96, 97 and 98 are progressively lower in height the further away they are located outwardly from the centre of the end of the spacer flap 92. The location of the pair of tongues 97 behind the locking tabs 106 is filer designed to stiffen and to enhance the integrity of the snap fit provided by the heel portion 116 once it has locked behind the outermost edge 118 of the aperture 114.

As is clear from FIG. 9, the outermost major surface of the spacer flap 92 defines a facade 124 having a pair of rectangular recessed panels 126 and 128 formed therein and arranged to receive labels or print for identifying the files. One particular advantage of the facade is that it may be used to replace the outermost surface of an eating file for identification purposes. The file is thus stored with its spine innermost and the spacer flap outermost with the facade exposed. In one embodiment, a separate print-receiving material may be moulded over the recesses. The file stiffener is also colour coded, so that differently coloured groups of file stiffeners may be used to readily identify different batches of files according to the type of documentation stored therein.

The file stiffener 86 may be incorporated in a file, rather than being retrofitted. In this embodiment, the flap engaging element 88 is formed integrally with or affixed to the inner surface of a file cover during manufacture of the file. Likewise, the rigidifying element 90 is hinged directly to the opposed file cover edge.

Referring now to FIGS. 10A to 10C, a fastening stud 130 is used as an alternative to double sided tape or the like for fastening a flap engaging element 132 or a rigidifying flap to the file cover 134. Both the file cover 134 and the engaging element 132 are provided wit apertures 136 and 138 through which the fastening element is passed for fixing the mounting element 132 firmly to the file cover 134. The fastening stud 130 comprises a head 140 and a split shaft 142 terminating in an expanded retaining formation 144 which is arranged to locate behind an outer surface of the engaging element 132.

In FIG. 11, a spacer flap 146 is shown fitted to a flap engaging element 148. The flap engaging element 148 is formed with a channel 150 which terminates in an expanded well formation 152. The spacer flap 148 has a tongue 154 terminating in a complementally expanded head 156 which forms a snap fit within the keyed slot formation 152. The tongue 154 thus serves both a flap locating and a flap locking function.

Figure 12:
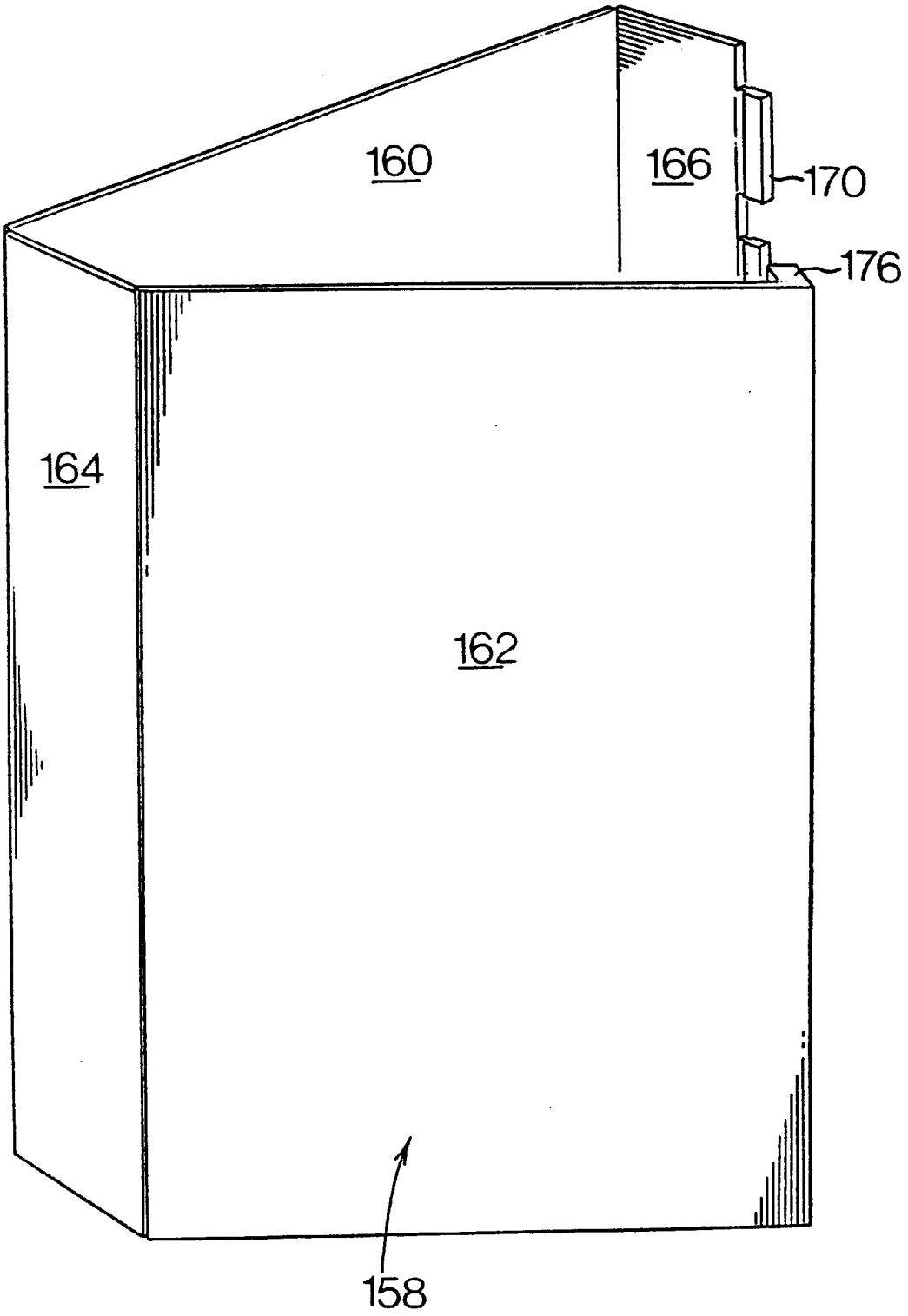
FIG. 12 shows a perspective view of a file of the invention incorporating an integral rigidifying element.
Figure 13:
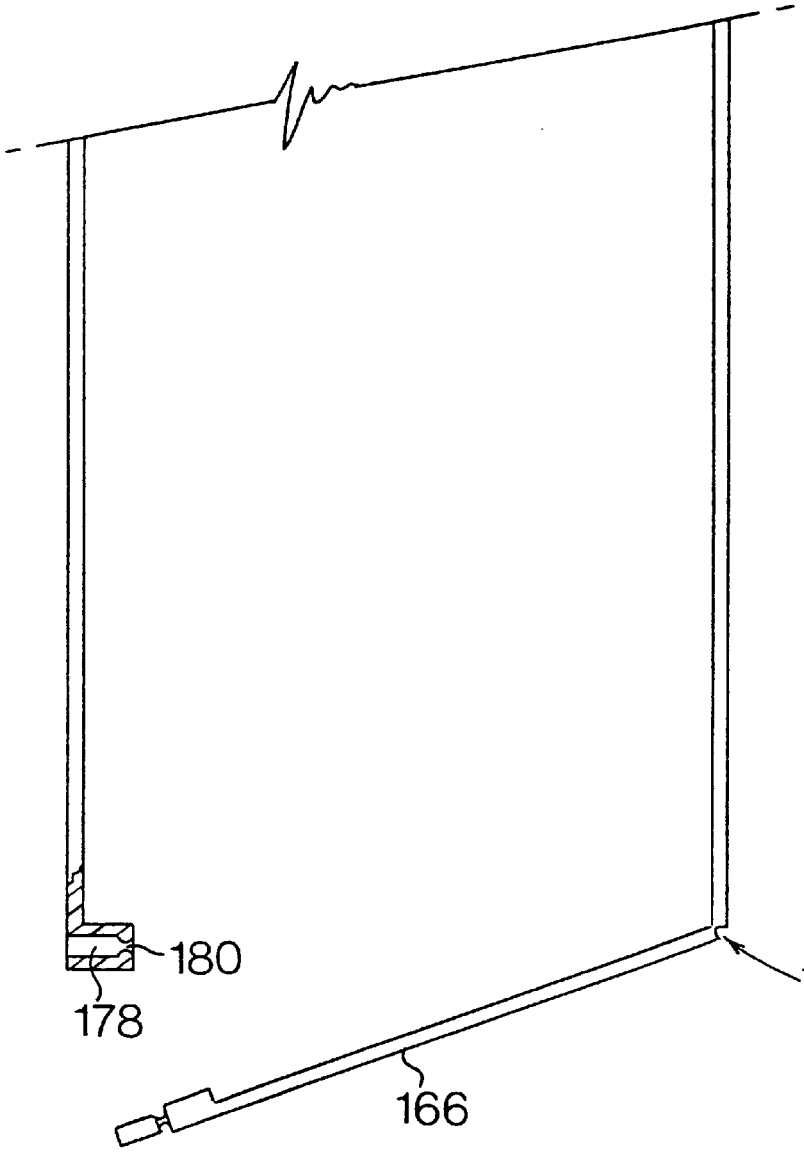
FIG. 13 shows a partially sectional top-plan view of the file of FIG. 12.
Figure 13B:
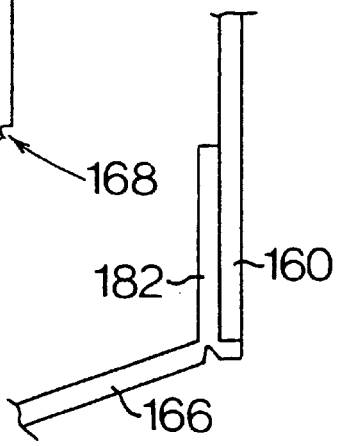
FIG. 13B shows an alternative embodiment in which the flap is fastened detachably to the other file cover.
Figure 13A:
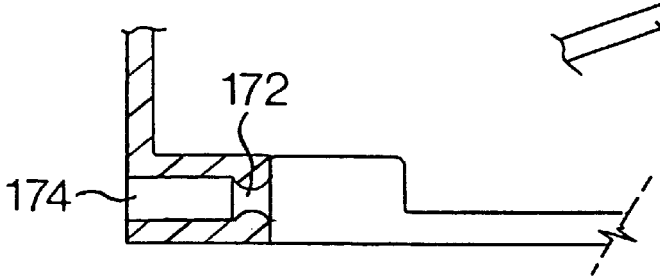
FIG. 13A shows a detail of fastening means used to fasten the flap of FIGS. 12 and 13 to the file cover.

Referring now to FIGS. 12, 13 and 13*a*, a file 158 is shown having first and second covers 160 and 162 hinged to and spaced apart from one another by a rigid spine 164. A rigidifying flap 166 is hinged to a free edge of the cover 160 remote from and parallel to the spine 164 along the weakened hinge zone 168. An array of flap fastening tongues 170 extend from the free edge of the flap 166 in the plane of the flap, and comprise a narrowed neck portion 172 and an expanded head portion 174. A plurality of complemental channel or groove formations 176 extend inwardly at right angles from the free edge of the cover 162 and define tongue-locating grooves or channels 178 having restricted openings 180. It can clearly be seen in FIG. 13A how the head 174 engages the channel 178 in a snap fit, with the narrowed neck portion 172 located snugly within the restricted opening 180 of the channel. An advantage of this embodiment is that, provided the flap 166 is perpendicular to the cover 160, the tongues 170 locate automatically within the corresponding grooves on closure of the file.

The entire file may be of a unitary construction, and may be injection moulded from a suitable plastics material. Alternatively, the covers 160 and 162 may be welded along or adjacent the hinge zones to the spine 164, and the flap 166 may be welded to the first cover 160.

In FIG. 13B, a further embodiment is shown in which the flap 166 has a flange 182 which is welded, rivetted, glued or otherwise affixed to the first cover 160.

One significant advantage of the file stiffener of the invention is that it can as easily be fatted to eating lever arch-type files as it can be factory-fitted, or incorporated into new files. Such files are thus upgraded, in that they become free-standing. The appropriately modified files can now be stored neatly and systematically, without the need for separate comparentalised storage boxes and the like.

We claim:

1. A file stiffener for stiffening a file of the type having a pair of opposed covers hinged to and spaced apart from one another by a spine, the file stiffener comprising at least one rigidifying spacer element, and mounting means for mounting the spacer element between the opposed covers, the spacer element having substantially the same rectangular dimensions as the file spine so as to hold the covers apart in a rigid parallel configuration and to form a rigid rectangular open-ended cylinder, and including a planar rigidifying flap having a hinged end arranged to be mounted to a free edge of the one file cover, and a flap engagement formation arranged to be mounted to a free edge of the other filed cover, and fastening means for fastening a free edge of the rigidifying flap detachably to the flap engagement formation, the fastening means comprising locating and stop means arranged to prevent longitudinal shear movement of the rigidifying flap relative to the other file cover in a direction parallel to the free edge of the rigidifying flap; and in which the fastening means includes locating means for detachably locking the free edge of the rigidifying flap to the flap engagement formation in a snap fit; and in which the locking means comprises at least one resilient clip formation extending from the flap engagement formation and a corresponding clip-receiving aperture defined in the rigidifying flap, the clip formation terminating in a finger-actuable tab for selectively disengaging the clip formation from the aperture.

2. A file stiffener according to claim 1 in which the planar rigidifying flap is hinged to a marginal flange along an integrally formed hinge zone, the flange being arranged to be mounted by the mounting means to an inner surface of one of the file covers adjacent the free edge thereof.

3. A file stiffener according to claim 2 in which the hinge zone is formed so as not to extend laterally beyond a plane defined by an outer surface of the one file cover to which the marginal flange is mounted.

4. A file stiffener for stiffening a file of the type having a pair of opposed covers hinged to and spaced apart from one another by a spine, the file stiffener comprising at least one rigidifying spacer element, and mounting means for mounting the spacer element between the opposed covers, the spacer element having substantially the same rectangular dimensions as the file spine so as to hold the covers apart in a rigid parallel configuration and to form a rigid rectangular open-ended cylinder, and including a planar rigidifying flap having a hinged end arranged to be mounted to a free edge of the one file cover, and a flap engagement formation arranged to be mounted to a free edge of the other file cover, and fastening means for fastening a free edge of the rigidifying flap detachably to the flap engagement formation, the fastening means comprising locating and stop means arranged to prevent longitudinal shear movement of the rigidifying flap relative to the other file cover in a direction parallel to the free edge of the rigidifying flap; and in which the fastening means includes at least one clip formation extending from the rigidifying flap and a corresponding clip-receiving groove defined in the flap-engaging element with which the clip formation is engageable in a snap fit.

5. A file stiffener for stiffening a file of the type having a pair of opposed covers hinged to and spaced apart from one another by a spine, the file stiffener comprising at least one rigidifying spacer element, and mounting means for mounting the spacer element between the opposed covers, the spacer element having substantially the same rectangular dimensions as the file spine so as to hold the covers apart in a rigid parallel configuration and to form a rigid rectangular open-ended cylinder, and including a planar rigidifying flap having a hinged end arranged to be mounted to a free edge of the one file cover, and a flap engagement formation arranged to be mounted to a free edge of the other file cover, and fastening means for fastening a free edge of the rigidifying flap detachably to the flap engagement formation, the fastening means comprising locating and stop means arranged to prevent longitudinal shear movement of the rigidifying flap relative to the other file cover in a direction parallel to the free edge of the rigidifying flap; and in which the locating and stop means comprises at least one tongue and at least one corresponding tongue-locating groove, with the groove being substantially the same length as the tongue and terminating in webs defining stop formations against which opposed minor ends of the tongue are arranged to abut.

6. A file stiffener according to claim 1 in which the rigidifying flap defines at least one finger-engageable aperture and an operatively outermost facade for receiving indicia for identifying the file, the facade thereby being adapted to consistently become the exposed display surface of the file in preference over the existing file spine.

7. A file comprising first and second planar covers hinged to and spaced apart from one another by a rigid spine, a rigidifying flap hinged to a free edge of the first cover remote from and parallel to the spine, and flap fastening means comprising a flap engagement formation located on an opposed free edge of the second cover and a flap fastening formation located towards a free edge of the rigidifying flap, the flap fastening formation being engageable with the flap engagement formation for fastening the flap detachably to the second cover, so as to form a rigid rectangular open-ended cylinder with the first and second covers being opposed and parallel to one another and the file spine and the flap being opposed and parallel to one another, the flap fastening means further comprising locating and stop means arranged to prevent longitudinal shear movement of the rigidifying flap relative to the second cover in a direction parallel to the free edge of the rigidifying flap; and in which the fastening means includes locking means for detachably locking the free edge of the flap to the flap engagement formation in a snap fit; and in which the locking means comprises at least one resilient clip formation extending from the flap engagement formation and a corresponding clip-receiving aperture defined in the rigidifying flap, the clip formation terminating in a finger-actuable tab for selectively disengaging the clip formation from the aperture.

8. A file according to claim 7 in which the rigidifying flap is arranged to pivot inwardly towards the spine before engagement of the fastening means and outwardly away from the spine immediately after disengagement of the fastening means.

9. A file according to claim 7 in which the rigidifying flap has an operatively outermost facade visibly exposed over the existing file spine when the file is in a stowed position.

10. A file according to claim 9 in which the facade includes at least one recessed portion defining a zone for receiving labels or other indicia for identifying the file, and at least one finger-engageable aperture is defined in the rigidifying flap.

11. A file according to claim 12 in which the fastening means includes locking means for detachably locking the free edge of the rigidifying flap to the flap engagement formation in a snap fit.

12. A file comprising first and second planar covers hinged to and spaced apart from one another by a rigid spine, a rigidifying flap hinged to a free edge of the first cover remote from and parallel to the spine, and flap fastening means comprising a flap engagement formation located on an opposed free edge of the second cover and a flap fastening formation located towards a free edge of the rigidifying flap, the flap fastening formation being engageable with the flap engagement formation for fastening the flap detachably to the second cover, so as to form a rigid rectangular open-ended cylinder with the first and second covers being opposed and parallel to one another and the file spine and the flap being opposed and parallel to one another, the flap fastening means further comprising locating and stop means arranged to prevent longitudinal shear movement of the rigidifying flap relative to the second cover in a direction parallel to the free edge of the rigidifying flap; and in which the fastening means includes at least one clip formation extending from the rigidifying flap and a corresponding clip-receiving groove defined in the flap-engaging element with which the clip formation is engageable in a snap fit.

13. A file comprising first and second planar covers hinged to and spaced apart from one another by a rigid spine, a rigidifying flap hinged to a free edge of the first cover remote from and parallel to the spine, and flap fastening means comprising a flap engagement formation located on an opposed free edge of the second cover and a flap fastening formation located towards a free edge of the rigidifying flap, the flap fastenings formation being engageable with the flap engagement formation for fastening the flap detachably to the second cover, so as to form a rigid rectangular open-ended cylinder with the first and second covers being opposed and parallel to one another and the file spine and the flap being opposed and parallel to one another, the flap fastening means further comprising locating and stop means arranged to prevent longitudinal shear movement of the rigidifying flap relative to the second cover in a direction parallel to the free edge of the rigidifying flap; and in which the locating and stop means comprises at least one tongue and at least one corresponding tongue-locating groove, with the groove being substantially the same length as the tongue and terminating in webs defining stop formations against which opposed minor ends of the tongue are arranged to abut.

14. A file according to claim 13 in which the tongue projects in the plane of the flap and the groove extends transversely from the second cover towards the tongue.

15. A file according to claim 13 in which the file is unitary or one-piece and is injection molded from a plastics material.

* * * * *